US006092003A

United States Patent [19]

Hagart-Alexander et al.

[11] Patent Number: 6,092,003

[45] **Date of Patent: *Jul. 18, 2000**

[54] PAPER STOCK SHEAR AND FORMATION CONTROL

[75] Inventors: Claud Hagart-Alexander, Vancouver, Canada; Hung-Tzaw Hu, Saratoga, Calif.; David Watson, Etobicoke, Canada; John Preston, Los Altos, Calif.

[73] Assignee: Honeywell-Measurex Corporation, Cupertino, Calif.

[ * ] Notice: This patent is subject to a terminal disclaimer.

[21] Appl. No.: 09/093,529

[22] Filed: Jun. 8, 1998

Related U.S. Application Data

[63] Continuation-in-part of application No. 09/013,802, Jan. 26, 1998.

[51] Int. Cl.[7] ..... G06F 19/00; G06F 7/66

[52] U.S. Cl. ..... 700/129; 700/122; 700/127; 700/128; 700/142

[58] Field of Search ..... 364/471.01, 471.02, 364/471.03, 470.13, 469.01, 474.15, 474.21, 474.28; 700/127, 128, 129, 142, 122, 173, 179, 186

[56] References Cited

U.S. PATENT DOCUMENTS

| | | | |
|---|---|---|---|
| 3,206,642 | 9/1965 | Canter et al. | 162/252 |
| 3,593,128 | 7/1971 | Perry | 324/666 |
| 3,630,836 | 12/1971 | Bietry et al. | 162/198 |
| 3,636,327 | 1/1972 | Troutman | 702/175 |
| 3,646,434 | 2/1972 | Norwich | 324/669 |
| 3,654,075 | 4/1972 | Keyes et al. | 162/254 |
| 3,713,986 | 1/1973 | Lippke | 162/263 |
| 3,723,712 | 3/1973 | Komline, Sr. et al | 204/549 |
| 3,723,865 | 3/1973 | Batey et al. | 324/665 |
| 3,795,984 | 3/1974 | Meyer | 34/535 |
| 3,811,087 | 5/1974 | Schmelzer | 324/688 |
| 3,864,626 | 2/1975 | MacLean et al. | 324/663 |
| 3,909,380 | 9/1975 | Day et al. | 204/549 |
| 3,986,110 | 10/1976 | Overall et al. | 73/304 C |
| 4,135,151 | 1/1979 | Rogers et al. | 324/664 |
| 4,259,632 | 3/1981 | Ahtiainen | 324/664 |
| 4,314,878 | 2/1982 | Lee | 162/198 |
| 4,329,201 | 5/1982 | Bolton | 162/198 |
| 4,369,080 | 1/1983 | Johnson | 156/64 |
| 4,374,703 | 2/1983 | Lebeau et al. | 162/253 |
| 4,398,996 | 8/1983 | Bolton et al. | 162/198 |
| 4,468,611 | 8/1984 | Tward | 324/673 |
| 4,474,643 | 10/1984 | Lindblad | 162/198 |
| 4,514,812 | 4/1985 | Miller et al. | 700/196 |

(List continued on next page.)

*Primary Examiner*—William Grant
*Assistant Examiner*—Iván Calcaño
*Attorney, Agent, or Firm*—Burns, Doane, Swecker & Mathis, L.L.P.

[57] ABSTRACT

System and method for producing paper are provided. The system controls formation of wet stock comprising fibers on a moving water permeable wire of a de-watering machine that has a refiner that is subject to a variable load and a headbox having at least one slice, wherein each slice has an aperture through which wet stock is discharged at a stock jet speed onto the wire that is moving at a wire speed. A sheet of wet stock moving a speed develops on the wire. The system includes: a) at least two water weight sensors that are positioned adjacent to the wire wherein the at least two sensors are positioned at different locations in the direction of movement of the wire and upstream from a dry line which develops during operation of the machine and the sensors generate signals indicative of a water weight profile made up of a multiplicity of water weight measurements; and b) means for adjusting at least one of the stock jet speed, sheet speed, wire speed, or refiner load to cause the water weight profile to match a preselected or optimal water weight profile. Techniques for predicting the dry stock weight of wet stock on the wire can be employed to assess the effect of adjusting the operating parameters. In addition, employing two sensors placed in the machine direction, the sheet speed can be determined by measuring the water weigh profile of a segment of the sheet and the time required for the segment to travel from one sensor to the next.

36 Claims, 6 Drawing Sheets

U.S. PATENT DOCUMENTS 4,535,285 8/1985 Evans et al. ..... 324/71.1
4,580,233 4/1986 Parker et al. ..... 73/73
4,588,943 5/1986 Hirth ..... 324/664
4,613,406 9/1986 Gess ..... 162/49
4,648,715 3/1987 Ford, Jr. et al. ..... 204/452
4,680,089 7/1987 Aral et al. ..... 162/198
4,692,616 9/1987 Hegland et al. ..... 250/252.1
4,707,779 11/1987 Hu ..... 700/55
4,748,400 5/1988 Typpo ..... 324/670
4,786,529 11/1988 Boissevain ..... 427/296
4,791,353 12/1988 Typpo ..... 324/667
4,817,021 3/1989 Sowerby et al. ..... 702/137
4,827,121 5/1989 Vidrine, Jr. et al. ..... 356/346
4,840,706 6/1989 Campbell ..... 162/698
4,845,421 7/1989 Howarth et al. ..... 324/688
4,903,528 2/1990 Balakrishnan et al. ..... 73/159
4,909,070 3/1990 Smith ..... 73/73
4,921,574 5/1990 Hu ..... 162/198
4,924,172 5/1990 Homgren ..... 324/664
4,947,684 8/1990 Balakrishnan ..... 73/159
4,957,770 9/1990 Howarth ..... 427/9
4,980,846 12/1990 Chapman ..... 700/167
4,986,410 1/1991 Shields ..... 198/444
4,990,261 2/1991 Ho ..... 210/709
4,994,145 2/1991 Seymour ..... 162/49
5,011,573 4/1991 Niemi ..... 162/259
5,013,403 5/1991 Chase ..... 162/198
5,020,469 6/1991 Boissevain et al. ..... 118/67
5,021,740 6/1991 Sarr et al. ..... 324/687
5,022,966 6/1991 Hu ..... 162/198
5,045,798 9/1991 Hendrick ..... 324/687
5,052,223 10/1991 Regnault et al. ..... 73/304 C
5,067,345 11/1991 Mougne ..... 73/61.44
5,093,795 3/1992 Lewis ..... 700/129
5,122,754 6/1992 Gotaas ..... 324/676
5,124,552 6/1992 Anderson ..... 250/339.04
5,132,631 7/1992 Klopfenstein et al. ..... 324/676
5,134,380 7/1992 Jones ..... 324/674
5,170,128 12/1992 Masurat et al. ..... 324/664
5,170,670 12/1992 Fasching et al. ..... 73/861.08
5,177,445 1/1993 Cross ..... 324/637
5,198,777 3/1993 Masuda et al. ..... 324/671
5,206,599 4/1993 Mayer ..... 324/671
5,208,544 5/1993 McBrearty et al. ..... 324/687
5,225,785 7/1993 Mayer et al. ..... 324/671
5,241,280 8/1993 Aidun et al. ..... 324/671
5,244,550 9/1993 Inoue ..... 204/518
5,247,261 9/1993 Gershenfeld ..... 324/716
5,262,955 11/1993 Lewis ..... 700/129
5,270,664 12/1993 McMurtry et al. ..... 324/690
5,280,250 1/1994 Jayaweera et al. ..... 324/452
5,340,442 8/1994 Gess et al. ..... 162/198
5,400,247 3/1995 He ..... 700/53
5,439,910 8/1995 de Fraine et al. ..... 514/256
5,450,015 9/1995 Mastico et al. ..... 324/665
5,492,601 2/1996 Ostermayer et al. ..... 162/198
5,539,634 7/1996 He ..... 700/38
5,561,599 10/1996 Lu ..... 700/44
5,563,809 10/1996 Williams et al. ..... 702/84
5,636,126 6/1997 Heaven et al. ..... 700/129
5,658,432 8/1997 Heaven et al. ..... 162/198
5,853,543 12/1998 Hu et al. ..... 162/198
5,928,475 7/1999 Chase et al. ..... 162/198

PAPER STOCK SHEAR AND FORMATION CONTROL

This is a continuation-in-part application of Ser. No. 09/013,802 that was filed on Jan. 26, 1998.

FIELD OF THE INVENTION

The present invention generally relates to controlling continuous sheetmaking and, more specifically, to controlling formation and fiber shear on the fourdriner wire of a papermaking machine.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices well known in the art are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking systems are further described, for example, in U.S. Pat. Nos. 5,539,634, 5,022,966 4,982,334, 4,786,817, and 4,767,935.

In the manufacture of paper on continuous papermaking machines, a web of paper is formed from an aqueous suspension of fibers (stock) on a traveling mesh papermaking fabric and water drains by gravity and vacuum suction through the fabric. The web is then transferred to the pressing section where more water is removed by dry felt and pressure. The web next enters the dryer section where steam heated dryers and hot air completes the drying process. The paper machine is essentially a de-watering system. In the sheetmaking art, the term machine direction (MD) refers to the direction that the sheet material travels during the manufacturing process, while the term cross direction (CD) refers to the direction across the width of the sheet which is perpendicular to the machine direction.

In the papermaking process, the major factors at the wire that influence the formation and strength of the paper include: (1) the stock jet speed to wire speed (jet/wire) ratio; (2) the angle that the stock jet lands on the wire; and (3) the rate of water drainage from the web. The speed differential between the stock jet and the wire speed determines the average orientation of the pulp fibers throughout the paper web between the cross, machine, and Z (wet stock height) directions. The average orientation of the fibers within the sheet is critical to both paper formation and sheet strength.

Current machine start-up procedures require optimization of the papermaking machine at different jet/wire ratios and to perform laboratory tests to identify the jet/wire ratio that produces the requisite formation and strength characteristics of the paper. The test results may take several hours and require several trial-and-error changes to the jet/wire ratio before acceptable results are obtained.

SUMMARY OF THE INVENTION

The present invention is based in part on the development of an underwire water weight sensor (referred to herein as the "$UW^3$" sensor) which is sensitive to three properties of materials: the conductivity or resistance, the dielectric constant, and the proximity of the material to the $UW^3$ sensor. Depending on the material, one or more of these properties will dominate. The $UW^3$ sensors are positioned in a papermaking machine in the MD direction, and are used to measure the conductivity of an aqueous mixture (referred to as wet stock) in a papermaking system. In this case, the conductivity of the wet stock is high and dominates the measurement of the $UW^3$ sensor. The proximity is held constant by contacting the support web in the papermaking system under the wet stock. The conductivity of the wet stock is directly proportional to the total water weight within the wet stock; consequently, the sensors provide information which can be used to monitor and control the quality of the paper sheet produced by the papermaking system. With the present invention, an array of $UW^3$ sensors is employed to measure the water weight in the MD on the web of a fourdriner paper machine and generate water weight or drainage profiles.

These sensors have a very fast response time (1 msec) and are capable of providing an accurate value of the water weight, which relates to the basis weight of the paper. Indeed, the water weight measurements can be computed from the under the wire weight sensor 600 times a second. By monitoring the MD trend of each of the MD sensors in the array, it is possible to correlate the variation of the water weight down the table between each of these sensors. The offset, in terms of time, that is required to overlay these trends to provide the desired correlation is the time that it takes for the unsupported stock slurry to travel from one sensor to the next. From this time, the control system can calculate the speed of the stock down the wire with relation to the wire speed. Since this unsupported stock slurry speed relates to the original stock jet speed, the control system can then monitor and control the jet-to-wire speed ratio and optimize this ratio to give the optimal sheet formation and strength.

The method for tuning the operation of a fourdriner machine to produce a specific paper grade comprises a three-step procedure. The first step comprises tuning process parameters of the fourdriner machine to obtain an optimized configuration which produces acceptable quality paper as determined by direct measurement. The drainage profile corresponding to this optimized configuration is then measured with water weight sensors distributed along the machine direction, and recorded.

This optimal drainage profile may then be fitted to various parameterized functions (such as an exponential) using standard curve fitting techniques. This curve fitting procedure has the effect of smoothing out the effects of noise on the profile, and interpolating between measured points.

During subsequent production runs of the fourdriner machine, the objective is to reproduce the previously determined optimal drainage profile. If the measured moisture content at a given position is either above or below the optimal value for that position, the machine parameters, such as the stock jet speed to wire speed ratio, are adjusted as necessary to bring that measurement closer toward the optimal value.

In one aspect, the invention is directed to a system of controlling that formation of wet stock which comprises fibers on a moving water permeable wire of a de-watering machine that comprises a refiner that subjects the fibers to mechanical action, said refiner having a motor load controller, and a headbox having at least one slice, wherein each slice has an aperture through which wet stock is discharged at a stock jet speed onto the wire that is moving at a wire speed and a sheet of the wet stock develops the wire and moves at a sheet speed, which system includes:

a) at least two water weight sensors that are positioned adjacent to the wire wherein the sensors are positioned at different locations in the direction of movement of the wire and upstream from a dry line which develops during operation of the machine and the sensors generate signals indicative of a water weight profile made up of a multiplicity of water weight measurements; and b) means for adjusting at least one of the stock jet speed, sheet speed, wire speed, or motor load controller to cause the water weight profile to match a preselected water weight profile.

The invention will, among other things, increase productivity as the papermaker can now quickly determine the proper jet-to-wire ratio for a particular grade of paper. The paper produced will have optimum fiber orientation that is reflected in the sheet formation and strength.

In a preferred embodiment, the system will also include means for predicting the dry basis weight of the sheet of wet stock on the wire.

DETAILED DESCRIPTION OF PREFERRED EMBODIMENTS

The present invention employs a system that includes a plurality of sensors that measure water weight in the MD along the web or wire at the wet end of a papermaking machine, e.g., fourdrinier. These $UW^3$ sensors have a very fast response time (1 msec) so that an essentially instantaneous MD profile of water weight can be obtained. Although the invention will be described as part of a fourdrinier papermaking machine, it is understood that the invention is applicable to other papermaking machines including, for example, twin wire and multiple headbox machines and to paper board formers such as cylinder machines or Kobayshi Formers. Some conventional elements of a papermaking machine are omitted in the following disclosure in order not to obscure the description of the elements of the present invention.

Figure 1A:
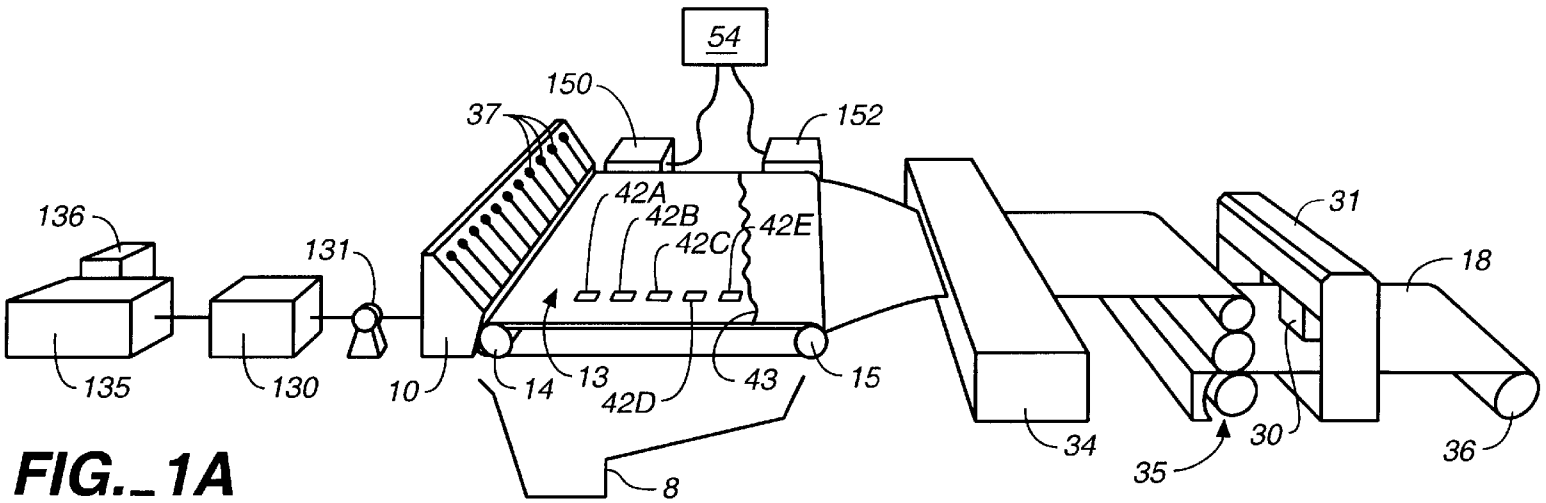
FIG. 1A shows a sheetmaking system implementing the technique of the present invention.

FIG. 1A shows a system for producing continuous sheet material that comprises headbox 10, a calendaring stack 35, and reel 36. Actuators 37 in headbox 10 discharge raw material through a plurality of slices onto supporting web or wire 13 which rotates between rollers 14 and 15 which are driven by motors 150 and 152, respectively. Controller 54 regulates the speed of the motors. Foils and vacuum boxes (not shown) remove water, commonly known as "white water", from the wet stock on the wire into the wire pit 8 for recycle. Sheet material exiting the wire passes through a dryer 34. A scanning sensor 30, which is supported on supporting frame 31, continuously traverses the sheet and measures properties of the finished sheet in the cross-direction. Multiple stationary sensors could also be used. Scanning sensors are known in the art and are described, for example, in U.S. Pat. Nos. 5,094,535, 4,879,471, 5,315,124, and 5,432,353, which are incorporated herein by reference. The finished sheet product 18 is then collected on reel 36. As used herein, the "wet end" portion of the system depicted in FIG. 1A includes the headbox, the web, and those sections just before the dryer, and the "dry end" comprises the sections that are downstream from the dryer.

An array of five $UW^3$ sensors 42A–42E is positioned underneath web 13. By this meant that each sensor is positioned below a portion of the web which supports the wet stock. As further described herein, each sensor is configured to measure the water weight of the sheet material as it passes over the sensor. The sensor provides continuous measurement of the sheet material along the MD direction at the points where it passes each sensor. The sensors are positioned upstream from the dry line 43. A water weight profile made up of a multiplicity of water weight measurements at different locations in the MD is developed. An MD array with a minimum of two sensors is required, preferably 4 to 6 sensors are employed and preferably the sensors are positioned in tandem in the MD about 1 meter from the edge of the wire. Preferably, the sensors are about 30 to 60 cm apart.

In another embodiment, each sensor in the MD array can be replaced with a CD array of the $UW^3$ sensors, that is, each of the five sensors 42A–42E comprises a CD array. Each CD array provides a continuous measurement of the entire sheet material along the CD direction at the point where it passes the array. A profile made up of a multiplicity of water weight measurements at different locations in the CD is developed. An average of these multiple measurements is obtained for each of the five CD arrays can be obtained and an MD profile based on the five average values generated.

The term "water weight" refers to the mass or weight of water per unit area of the wet paper stock which is on the web. Typically, the water weight sensors are calibrated to provide engineering units of grams per square meter (gsm). As an approximation, a reading of 10,000 gsm corresponds to paper stock having a thickness of 1 cm on the fabric. The term "basis weight" refers to the total weight of the material per unit area. The term "dry weight" or "dry stock weight" refers to the weight of a material (excluding any weight due to water) per unit area.

It has been demonstrated that fast variations of water weight on the wire correlate well to fast variations in dry basis weight of the sheet material produced when the water weight is measured upstream from dry line on the wire. The reason is that essentially all of the water on the wire is being held by the paper fibers. Since more fibers hold more water, the measured water weight correlates well to the fiber weight.

The papermaking raw material is metered, diluted, mixed with any necessary additives, and finally screened and cleaned as it is introduced into headbox 10 from source 130 by fan or feeding pump 131. This pump mixes stock with the white water and deliver the blend to the headbox 10.

The process of preparing the wet stock includes the step of subjecting the fibers to mechanical action in refiner 135 which includes a variable motor load controller 136. By regulating the refiner one can, among other things, regulate strength development and stock drainability and sheet formation. Many variables affect the refining process and these generally include, for example, the raw materials (e.g., fiber morphology), equipment characteristics, and process variables (e.g., pH). With respect to fiber morphology, it is known that the source of the wood pulp fibers will influence the properties of the paper. Two important characteristics are fiber length and cell wall thickness. A minimum length is required for interfiber bonding, and length is proportional to tear strength. The ratio of pulp fiber length to cell wall thickness which is as an index of relative fiber flexibility and the fiber coarseness value, which is the weight of fiber wall material in a specified fiber length, are two indications of fiber behavior. Generally, pulp characteristics of softwood species differ from those of hardwood species and the paper stock can comprise different blends of softwood and hardwood. This stock ratio of softwood and hardwood can be regulated to affect changes in, for example, the drainability of the wet stock on the wire.

Figure 1B:
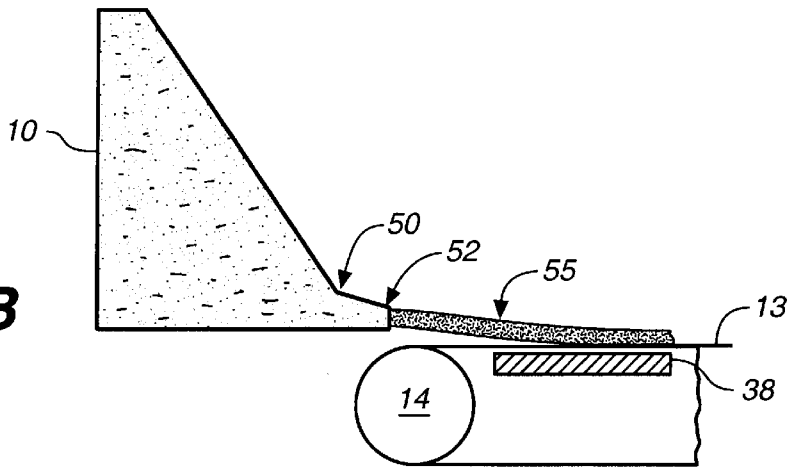
FIG. 1B shows the relationship of the slices in the headbox and the wire.

FIG. 1B illustrates headbox 10 having slices 50 which discharge wet stock 55 onto wire 13. In actual papermaking systems, the number of slices in the headbox will be higher. For a headbox that is 300 inches in length, there can be 100 or more slices. The rate at which wet stock is discharged through the nozzle 52 of the slice can be controlled by corresponding actuator which, for example regulates the diameter of the nozzle. The function of the headbox is to take the stock delivered by the fan pump and transform a pipeline flow into an even, rectangular discharge equal in width to the paper machine and at uniform velocity in the machine direction. Forming board 38 supports wire 13 at the point of jet impingement. The board serves to retard initial drainage.

Headboxes are typically categorized, depending on the required speed of stock delivery, as open or pressurized types. Pressurized headboxes can be further divided into air-cushioned and hydraulic designs. In the hydraulic design, the discharge velocity from the slice depends directly on the feeding pump pressure. In the air-cushioned type the discharge energy is also derived from the feeding pump pressure, but a pond level is maintained and the discharge head is attenuated by air pressure in the space above the pond.

The total head (pressure) within the box determines the slice jet speed. According to Bernoulli's equation: $v=(2gh)^{1/2}$ where v=jet velocity or speed (m/s); h=head of liquid (m); and g=acceleration due to gravity (9.81 $m/s^2$). The jet of stock emerging from a typical headbox slice contracts in thickness and deflects downward as a result of slice geometry. The jet thickness, together with the jet velocity, determines the volumetric discharge rate from the headbox. The headbox slice is typically a full-width orifice or nozzle with a completely adjustable opening to give the desired rate of flow. The slice geometry and opening determine the thickness of the slice jet, while the headbox pressure determines the velocity. As used herein, the term "stock jet speed" or "jet speed" refers to the speed of the jet of wetstock that goes through the nozzle of the slice.

Figure 6:
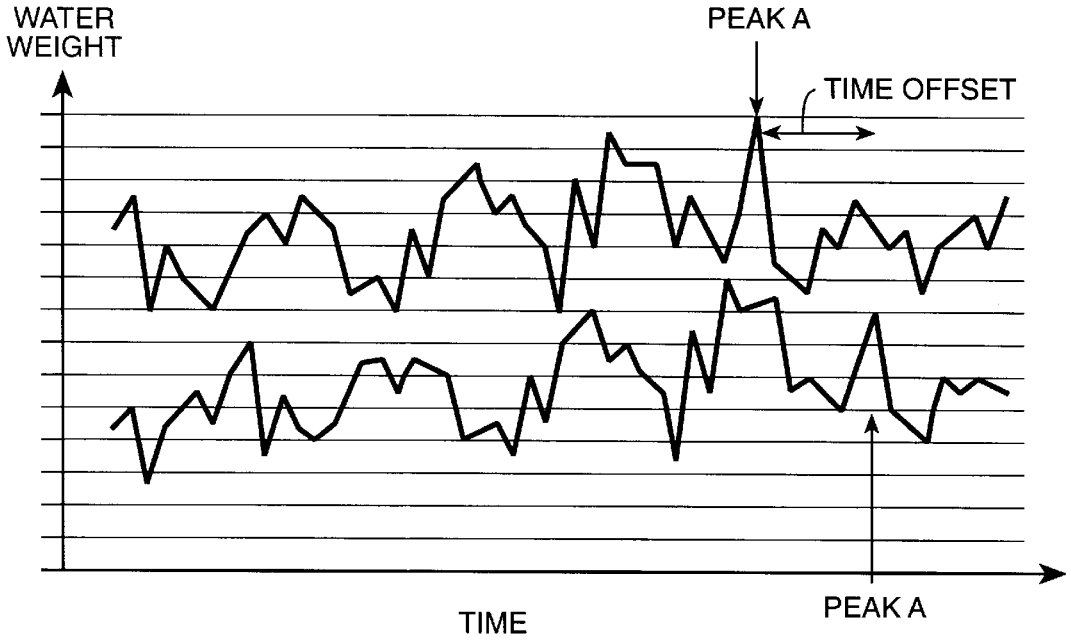
FIG. 6 is a graph of water weight vs. time as measure by two MD $UW^3$ sensors.

With the present invention, the speed of a sheet of wet stock moving on the wire can be measured using two or more $UW^3$ senors positioned in the MD. Although the amount of water in the stock decreases as the wire travels away from the headbox toward the dry end, the overall contour of the water weight profile of the stock will remain sufficiently constant to enable calculation of the stock speed. Shown in FIG. 6 is an exemplary graph of water weights versus time (milliseconds) measured at two $UW^3$ sensors that are positioned at two different MD positions on the wire as shown in FIG. 1. The top curve represents measurements by a sensor that is located closer to the headbox and the lower curve represents measurements for the other sensor. The curves demonstrate that the overall shape of the water profile remains the generally same even as water drains from the stock. Therefore, by continuously monitoring the two curves, the speed at which the sheet of wet stock travels between the two sensors can be calculated. Specifically, the speed is equal to the distance between the two sensors divided by the time offset, which is that time it takes point A on the stock or any identifiable segment to travel from one sensor to the next as illustrated in FIG. 6. As is apparent, more than two sensors can be employed; and from multiple readings and calculations, an average speed of the stock can be determined.

For measuring the speed of the moving sheet of wet stock on the wire, the two or more $UW^3$ sensors are preferably positioned in tandem along the MD which means that they are positioned the same distance from the edge of the wire. In this fashion, variations of the water weight in the stock along the cross direction will not adversely affect the speed measurements.

As evidenced by the data in FIG. 6, the response time of the $UW^3$ water weight sensors is fast enough so that distinctive variations in the water weight, e.g., peaks, can be readily identified. By "response time" is meant the time required for the sensor to make one reading. The response time is typically about 1 msec which is sufficient since the wire and the stock typically travels at a speed of about 8.3 to 22 m/sec. Preferably, for measuring the speed of the moving sheet, the response time of the sensor should be designed to be at least about 2 m sec or faster.

The main operating variables for the headbox are typically stock consistency and temperature and jet-to-wire speed ratio. Typically, the consistency is set low enough to achieve good sheet formation, without compromising first-pass retention or exceeding the drainage capability of the forming section. Since higher temperature improves stock drainage, temperature and consistency are interrelated variables. Consistency is varied by raising or lowering the slice opening. Since the stock addition rate is typically controlled only by the basis weight valve (not shown), a change in slice opening will mainly affect the amount of white water circulated from the wire pit under the wire.

The ratio of jet speed to wire speed is usually adjusted near unity to achieve best sheet formation. If the jet speed lags the wire, the sheet is said to be "dragged"; if the jet speed exceeds the wire speed, the sheet is said to be "rushed". Sometimes, it is necessary to rush or drag the sheet slightly to improve drainage or change fiber orientation. The jet speed is not actually measured, but is inferred from the headbox pressure. Typically, the papermaking machine is operated so that the ratio is not equal to 1, rather the ratio preferably ranges from about 0.95 to 0.99 or 1.01 to 1.05.

Practice of the invention relies in part on the development of one or more water weight profiles created during operation of the papermaking machine. The term "water weight profile" refers to a set of water weight measurements as measured by the MD array of sensors. Alternatively, the water weight profile can comprise a curve that is developed by standard curve fitting techniques from this set of measurements. In operation, water weight profiles are created for different grades of paper that are made under different operating conditions including different ambient conditions (e.g., temperature and humidity). For instance, when the machine of FIG. 1A is operating and making a specific grade of paper that has the desired physically properties as determined by laboratory analysis and/or measurement by the scanning sensor, measurements are taken with the $UW^3$ sensors. The measurements will be employed to create a base or optimal water weight profile for that specific grade of paper and under the specific conditions. A database containing base water weight profiles (or base profiles) for different grades of paper manufactured under various operating conditions can be developed. It should be noted that besides developing and maintaining a database of the base water weight profiles, the stock jet speed to wire speed ratio, i.e., jet/wire ratio, and measured stock sheet speed to wire speed ratio, i.e., sheet/wire ratio, for each profile will also be recorded. Furthermore, these ratios will be close to but not equal to 1. In this fashion, when the base profile from the database is employed to operate the papermaking machine, initially the machine will begin operation at the recorded jet/wire ratio or sheet/wire ratio. Thereafter, the ratio is manipulated in order to reproduce the base profile.

During start-up of the papermaking machine, the operator will select the proper base profile from the database. The array of $UW^3$ continuously develops measured water weight profiles which are compared to the base water weight profile. The jet/wire ratio or sheet/wire ratio is adjusted until the measured profile matches the base profile. Continual monitoring of the measured water weight profile allows the operator to adjust either ratio should the measured profile deviated beyond a preset range from base profile. Only the wet end of the machine needs to operate during this initial start-up stage. Materials are recycled during this period.

Employing two or more sensors to measure the speed of the sheet of wet stock (or "sheet speed) on the wire enables the operator of the papermaking machine to, among other things, insure that the jet speed as calculated from the head pressure of the headbox is accurate. Often the stock surges through the headbox slice; this pulsation phenomenon causes fluctuations in the jet speed. Since the speed of the sheet of wet stock on the wire is proportional to the stock jet speed, sheet speed can be employed to monitor the calculated jet speed. Should the measured speed indicate excessive fluctuations in the jet speed, the headbox pressure or other parameters can be adjusted accordingly to minimize the fluctuations. For instance, the slice aperture geometry or the stock flow from the refiner to the headbox can be adjusted.

Alternatively, the sheet speed can be used in place of the calculated jet speed so that the papermaking machine is maintained at the desired sheet stock speed to wire speed ratio. The preferred ranges of this ratio is typically the same as that for the jet to wire ratio. Furthermore, should the sheet speed to wire ratio require adjustment, the stock jet speed, wire speed, or motor load controller can be adjusted as before to cause the water weight profile to match a preselected water weight profile.

Because the stock jet speed through the slice is generally easier to controlled than the wire speed, a preferred method of adjusting the jet/wire ratio or sheet/wire ratio is to maintain a substantially constant wire speed and adjust the pressure in the headbox to regulate the stock jet speed. It is understood that the invention is applicable where the ratio is adjusted by controlling of the wire speed while maintaining a constant stock jet speed or by controlling both the jet speed and wire speed.

Figure 1C:
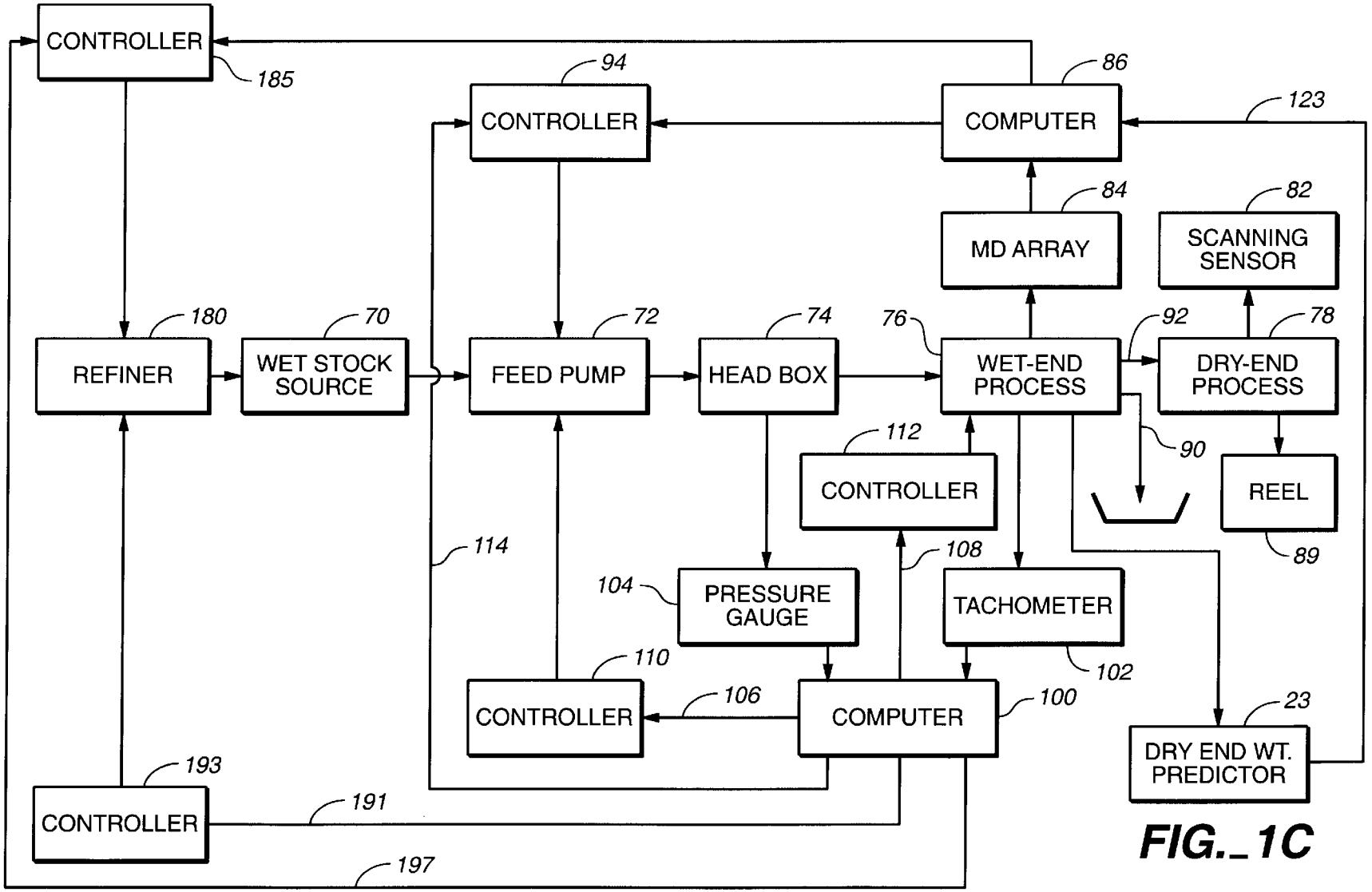
FIG. 1C is a generalized block diagram of the control system.

In operation of the system as illustrated in FIG. 1C, wet stock is pumped by feed pump 72 from source 70 to headbox 74. The wet stock is partially dewatered in the wet end process 76 that yields a partially dewatered product. During this initial start-up stage the partially dewatered product 90 can be collected for recycle. After this initial process has been completed, the partially dewatered product 92 will enter the dry end process 78 which yields finished paper that is collected at the reel 80. A scanning sensor 82 measures the dry end basis weight to confirm that the process parameters (e.g., jet/wire ratio) have been correctly selected.

During the initial stage, an MD array of sensors 84 measures the water weight at the wet end and transmit signals to computer 86 which continuously develops water weight profiles of the wet end process. These measured water weight profiles are compared to the base or optimal water weight profile that has been selected for the particular grade of paper being made from a database. FIG. 8 is a graph of water weight versus wire position illustrating implementation of the process. As shown, curve A represents a base or optimal profile that has been preselected from the database for the grade of paper that is being made. During the start-up phase, water weight measurements at the wire are made by the MD array of sensors and from measurements curve B is created using standard curve fitting methods.

Figure 7:
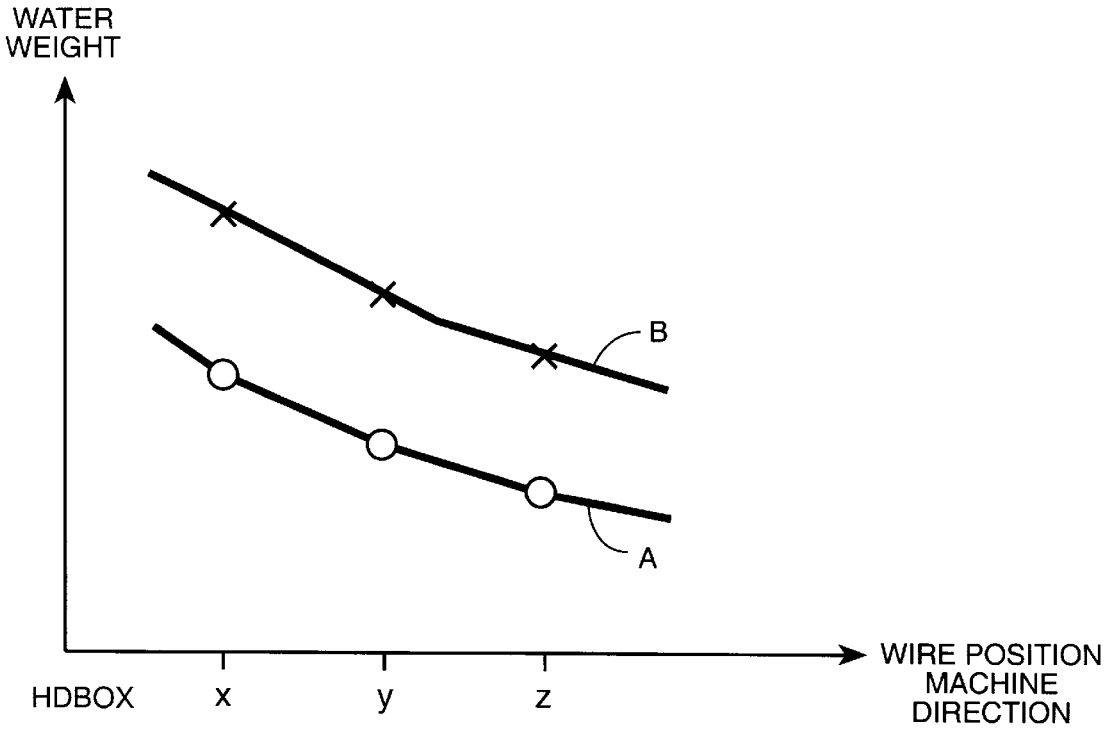
FIG. 7 is a graph of water weight vs. wire position on a papermaking machine.

As is apparent, in this case the measured water weight values are higher than those of the base profile. As a result, the computer will transmit appropriate signals to controller 94 that will regulate feed pump 72. This curve comparison procedure continues until the measured water weight profile matches the preselected optimized profile. In practice, 100% matching will not be necessary or practical and the level of deviation can be set by the operator. Therefore, it is understood that the term "match" or "matching" implies that the measured water weight profile has the same or approximately the same values as that of the preselected water base weight profile. Referring to FIG. 7, a preferred method of comparing the measured water weight values with those of the base profile entails comparing the three measurements at positions x, y, and z for each profile rather than the two curves. Furthermore, depending on the grade of paper, it may be that measurements closer to the dry line at position z may be more significant that those near the headbox at position x. In this case, the operator may require a higher degree of agreement at position z than at position x. After the proper jet/wire ratio or sheet/wire ratio is reached, i.e., when the measured profile matches the base profile, the dry end process goes on line and finished product is made.

As indicated above, the system is preferably operated within certain jet/wire or sheet/wire ratio ranges. To assure that the machine is operating within this parameter, the system preferable includes computer 100 which receives signals from wire speed measuring device (e.g., tachometer) 102 and headbox pressure gauge 104. The computer calculates the jet/wire or sheet/wire ratio. If the ratio is outside the ratio range (e.g., 1.01 to 1.05) that is set by the operator, the jet speed (or sheet speed as the case may be) and/or wire speed can be adjusted accordingly. For example, signal 106 can be transmitted to the controller 110 which increases or decreases the speed of the pump 72. This in turn increases or decreases the stock jet speed. The computer can also transmit appropriate signals to 108 to controller 112 which regulate the speed of the motors that drive the wire. In addition, the controller can transmit signal 114 to controller 94 which temporarily overrides operation of controller 94 until the ratio returns to the preset ratio range.

As is apparent, while it is preferred to maintain the jet/wire ratio within a preset range, in the case where either the stock jet speed or the wire speed is kept constant, it is not necessary actually to calculate the jet/wire ratio in order to implement the profile matching procedure. The only critical requirement is that the measured water weight profile matches the base profile. The analogous reasoning applies to the sheet/wire ratio.

FIG. 1C also illustrates a method of controlling the motor load of refiner 180 in response to wet end process signals. Specifically, when as in the case above, the measured water weight values are higher than those of the base profile, computer 86 will transmit appropriate signals to controller 185 that will regulate the load of refiner 180. Changing the load entails regulating the mechanical element in the refiner, e.g., increasing or decreasing the refiner plate gap to change the degree of mechanical action of the pulp. Furthermore, if the jet/wire or sheet/wire ratio is outside the ratio range that is set by the operator, signal 191 is transmitted by computer 100 to controller 193 to increase or decrease the motor load. The computer can also transmit appropriate signals 197 to controller 185 temporarily overrides operation of controller 185 until the ratio returns to the preset ratio range.

In another aspect of the invention, measurements by a plurality of MD $UW^3$ sensors can be employed to predict the basis weight of the final paper product. The predicted basis weight can be used to control operating parameters of the papermaking machine to optimize final paper product quality. As further described herein, a functional relationship between wet end basis weight (BW) and predicted dry end BW allows dry end BW predictor 23 to process water weight measurements made by the MD $UW^3$ sensors to predict what the dry basis weight or dry stock weight would be when it reaches the dry end as shown in FIG. 1C. The predicted dry basis weight is compared to a target setting to obtain an error signal, if any. The error signal is used to determine appropriate control signals for controlling machine elements such as, for example, the stock jet speed, sheet speed, wire speed, or the load of the refiner. In a preferred embodiment, signals from dry end predictor 23 are transmitted through line 123 to computer 86 which in turn can regulate the refiner, the wire motor speed, and headbox pressure as described above.

The predicted dry weight calculations can be employed to verify that changes to one or more parameters will have the anticipated effects on the final product. For example, if changes to the stock jet speed or measured sheet stock speed, wire speed, or the variable load of the refiner is made so that the water weight profile matches a preselected water weight profile, the predicted dry weight can quickly indicate whether the change(s) made will have the correct effect. Furthermore, where the operator has the option of changing one of many parameters, the technique of predicting the dry weight will enable the operator to quickly determine which parameter(s) are most suited to achieve water weight matching.

Structure of $UW^3$ Sensor

Figure 2:
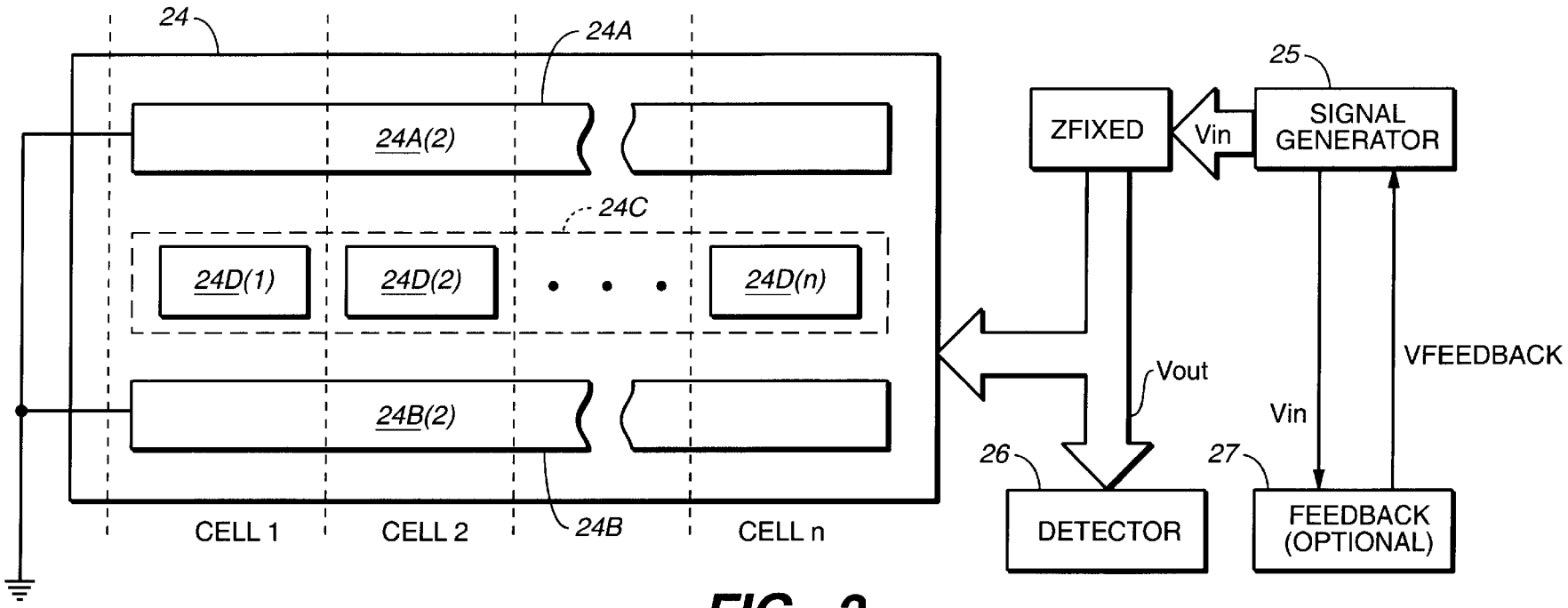
FIG. 2 is a block diagram of the measurement apparatus including a sensor array.

FIG. 2 shows a conductivity or resistance measurement sensor, described in U.S. patent application Ser. No. 08/766,864 now U.S. Pat. No. 5,891,306 which is incorporated herein by reference, which measures the conductivity or resistance of the water in the stock material. (The sensor can also measure the dielectric constant and the proximity of material, e.g., wet stock, to the sensor.) The conductivity of the water is proportional to the water weight. A sensor array includes two elongated grounded electrodes 24A and 24B and a segmented electrode 24C. Measurement cells (cell1, cell2, . . . celln) each include a segment of electrode 24C and a corresponding portion of the grounded electrodes (24A and 24B) opposite the segment. Each cell detects the conductivity of the paper stock and specifically the water portion of the stock residing in the space between the segment and its corresponding opposing portions of grounded electrode. Although the sensor array may comprise multiple cells, it is understood that each $UW^3$ sensor requires only one cell structure, e.g., cell 2 of FIG. 2. Indeed, even though the preferred detector comprises three electrodes, two of which are grounded, the required number of electrodes is only two, with one being ground.

Each cell is independently coupled to an input voltage (Vin) from signal generator 25 through an impedance element Zfixed and each provides an output voltage to voltage detector 26 on bus Vout. Signal generator 25 provides Vin.

Device 26 includes circuitry for detecting variations in voltage from each of the segments in electrodes 24C and any conversion circuitry for converting the voltage variations into useful information relating to the physical characteristics of the aqueous mixture. Optional feedback circuit 27 includes a reference cell having similarly configured electrodes as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in weight, the reference cell is configured so that the weight remains constant. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). It should also be noted that the non-weight related aqueous mixture conductivity information provided by the reference cell may also provide useful data in the sheetmaking process.

The sensor array is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e., $Rm=\infty$) between the electrodes and the sensor measures the dielectric constant of the material. Alternatively, for a highly conductive material, the resistance of the material is much less than the capacitive impedance (i.e., $Rm \ll Z_{Cm}$), and the sensor measures the conductivity of the material.

Figure 3:
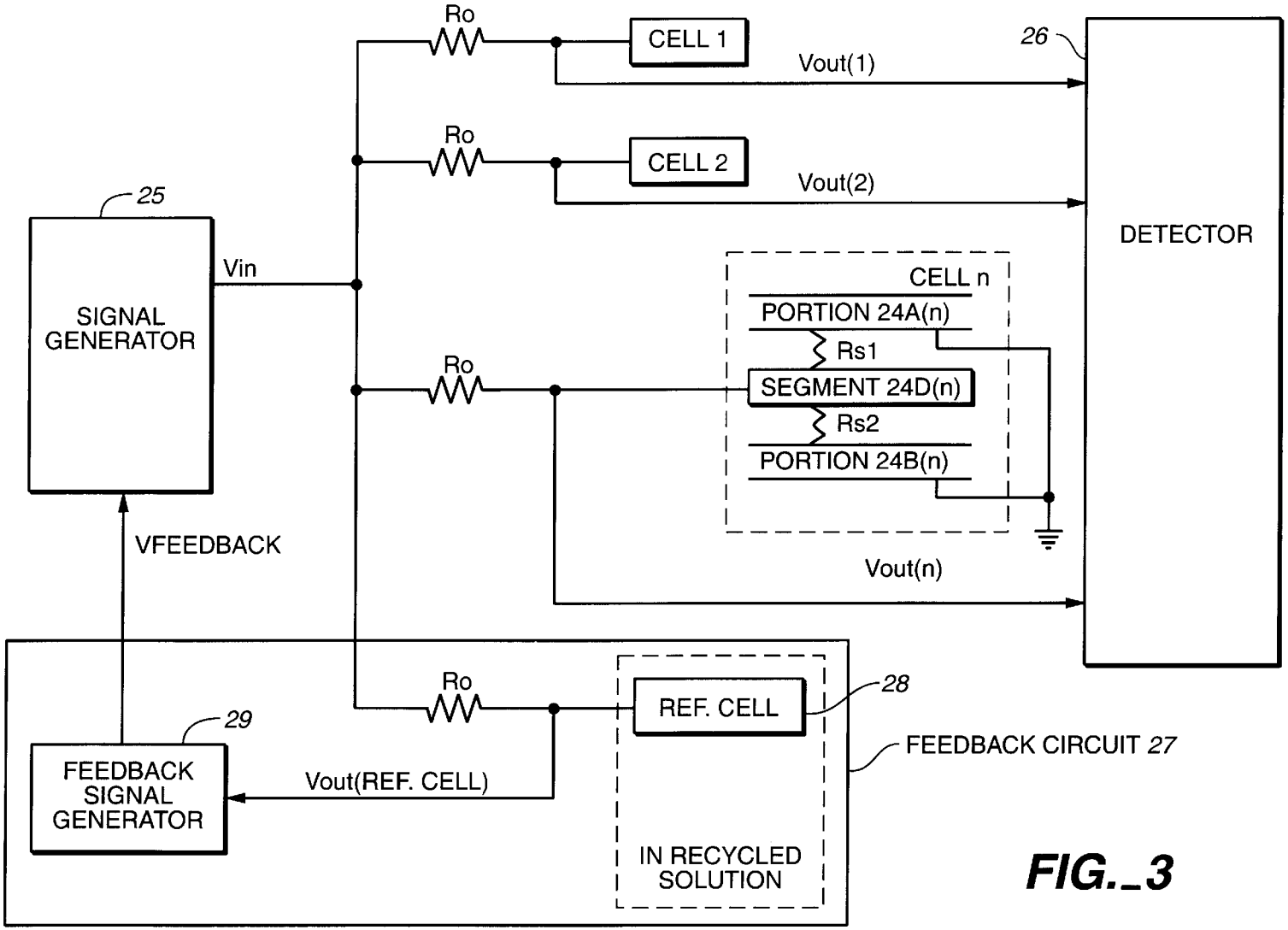
FIG. 3 shows an electrical representation of the block diagram shown in FIG. 2.

FIG. 3 illustrates an electrical representation of a measuring apparatus including cells 1–n of sensor array 24 for measuring conductivity of an aqueous material. As shown, each cell is coupled to Vin from signal generator 25 through an impedance element which, in this embodiment, is resistive element Ro. Referring to cell n, resistor Ro is coupled to center segment 24D(n) and portions 24A(n) and 24B(n) (opposite segment 24D(n)) are coupled to ground. Also shown in FIG. 6 are resistors Rs1 and Rs2 which represent the conductance of the aqueous mixture between the segments and the grounded portions. Resistors Ro, Rs1, and Rs2 form a voltage divider network between Vin and ground.

The measuring apparatus shown in FIG. 3 is based on the concept that the conductivity of the voltage divider network Rs1 and Rs2 of the aqueous mixture and the weight/amount of an aqueous mixture are inversely proportional. Consequently, as the weight increases/decreases, the combination of Rs1 and Rs2 decreases/increases. Changes in Rs1 and Rs2 cause corresponding fluctuations in the voltage Vout as dictated by the voltage divider network. The voltage Vout from each cell is coupled to detector 26. Hence, variations in voltage inversely proportional to variations in conductivity of the aqueous mixture are detected by detector 26 thereby providing information relating to the weight and amount of aqueous mixture in the general proximity above each cell. Detector 26 also typically includes other circuitry for converting the output signals from the cell into information representing particular characteristics of the aqueous mixture.

FIG. 3 also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if weight is desired to be sensed then the weight is kept constant so that any voltage changes generated by the reference cell are due to physical characteristics other than weight changes. In one embodiment, reference cell 28 is immersed in an aqueous mixture of recycled water which has the same chemical and temperature characteristics of the water in which sensor array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, caused from characteristic changes other than weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Predicting Dry end Basis Weight From Measurements of $UW^3$ Sensors

The following describes a preferred method of predicting the dry stock weight using the $UW^3$ sensors which is further described in U.S. application Ser. No. 08/789,086 filed on Jan. 27, 1997, now U.S. Pat. No. 5,853,543. In particular, the paper produced involves simultaneous measurements of (1) the water contents of the paper stock on the fabric or wire of the papermaking machine at three or more locations along the machine direction of the fabric and of (2) the dry stock weight of the paper product preceding the paper stock on the fabric. In this fashion, the expected dry stock weight of the paper that will be formed by the paper stock on the fabric can be determined at that instance. Specifically, the method of predicting the dry stock weight of a sheet of material that is on a moving water permeable fabric of a de-watering machine that includes a dryer section located downstream from the water permeable fabric, that comprises the steps of:

a) placing three or more water weight sensors adjacent to the fabric wherein the sensors are positioned at different locations in the direction of movement of the fabric and placing a sensor to measure the moisture content of the sheet of material after exiting the dryer section;

b) operating the machine at predetermined operating parameters and measuring the water weights of the sheet of material at the three or more locations on the fabric with the water weight sensors and simultaneously measuring the dry weight apart of the sheet of material exiting the dryer section;

c) performing bump tests to measure changes in water weight in response to perturbations in three or more operating parameters wherein each bump test is performed by alternately varying one of the operating parameters while keeping the others constant, and calculating the changes in the measurements of the three or more water weight sensors and wherein the number of bump tests correspond to the number of water weight sensors employed;

d) using said calculated changes in the measurements from step c) to obtain a linearized model, e.g., an N×M matrix, that expresses changes in the three or more water weight sensors as a function of changes in the three or more operating parameters about said predetermined operating parameters wherein N is equal to the number of water weight sensors employed and M is equal to the number of bump tests performed and N is equal to or greater than M; and e) developing a functional relationship, e.g., an inverted N×M matrix that provides the predicted dry weight for a segment for the moving sheet of material after being dried in the dryer section based on measurements from the three or more water weight sensors for said segment of the sheet material on the moving fabric.

Preferably, the bump tests comprise varying the flow rate of the aqueous fiber stock onto the fabric, freeness of the fiber stock, and concentration of fiber in the aqueous fiber stock. With the present invention, by continuously monitoring the water weight levels of the paper stock on the fabric, it is possible to predict the quality (i.e., dry stock weight) of the product. Furthermore, feedback controls can be implemented to change one or more operating parameters in response to fluctuations in predicted dry stock weight.

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency and wire speed. It has demonstrated that particularly useful drainage profiles can be generated by varying the following process parameters: 1) total water flow which depends on, among other things, the head box delivery system, head pressure and slice opening and slope position, 2) freeness which depends on, among other things, the stock characteristics and refiner power; and 3) dry stock flow and headbox consistency.

Water weight sensors placed at strategic locations along the paper making fabric can be used to profile the de-watering process (hereinafter referred to as "drainage profile"). By varying the above stated process parameters and measuring changes in the drainage profile, one can then construct a model which simulates the wet end paper process dynamics. Conversely one can use the model to determine how the process parameters should be varied to maintain or produce a specified change in the drainage profile. Furthermore with the present invention the dry stock weight of the web on the paper making fabric can be predicted from the water weight drainage profiles.

Three water weight sensors measure the water weight of the paper stock on the fabric. The position along the fabric at which the three sensors are located are designated "h", "m", and "d", respectively, respectively. More than three water weight sensors can be employed. It is not necessary that the sensors be aligned in tandem, the only requirement is that they are positioned at different machine directional positions. Typically, readings from the water weight sensor at location "h" which is closest to the head box will be more influenced by changes in stock freeness than in changes in the dry stock since changes in the latter is insignificant when compared to the large free water weight quantity. At the middle location "m", the water weight sensor is usually more influenced by changes in the amount of free water than by changes in the amount of dry stock. Most preferably location "m" is selected so as to be sensitive to both stock weight and free changes. Finally, location "d", which is closest to the drying section, is selected so that the water weight sensor is sensitive to changes in the dry stock because at this point of the de-water process the amount of water bonded to or associated with the fiber is proportional to the fiber weight. This water weight sensor is also sensitive to changes in the freeness of the fiber although to a lesser extent. Preferably, at position "d" sufficient amounts of water have been removed so that the paper stock has an effective consistency whereby essentially no further fiber loss through the fabric occurs.

In measuring paper stock, the conductivity of the mixture is high and dominates the measurement of the sensor. The proximity is held constant by contacting the support web in the papermaking system under the paper stock. The conductivity of the paper stock is directly proportional to the total water weight within the wetstock, consequently providing information which can be used to monitor and control the quality of the paper sheet produced by the papermaking system. In order to use this sensor to determine the weight of fiber in a paper stock mixture by measuring its conductivity, the paper stock is in a state such that all or most of the water is held by the fiber. In this state, the water weight of the paper stock relates directly to the fiber weight and the conductivity of the water weight can be measured and used to determine the weight of the fiber in the paper stock.

Formulation of Drainage Characteristics Curves

In this particular embodiment of the invention, three water weight sensors are used to measure the dependence of the drainage profile of water from the paper stock through the fabric on three machine operation parameters: (1) total water flow, (2) freeness of paper stock, and (3) dry stock flow or headbox consistency. Other applicable parameters include for example, (machine speed and vacuum level for removing water). For the case of three process parameters the minimum is three water weight sensors. More can be used for more detailed profiling.

A preferred form of modeling uses a baseline configuration of process parameters and resultant drainage profile, and then measures the effect on the drainage profile in response to a perturbation of an operation parameter of the fourdrinier machine. In essence this linearizes the system about the neighborhood of the baseline operating configuration. The perturbations or bumps are used to measure first derivatives of the dependence of the drainage profile on the process parameters.

Once a set of drainage characteristic curves has been developed, the curves, which are presented as a 3×3 matrix, can be employed to, among other things, predict the water content in paper that is made by monitoring the water weight along the wire by the water weight sensors.

Bump Tests

The term "bump test" refers to a procedure whereby an operating parameter on the papermaking machine is altered and changes of certain dependent variables resulting therefrom are measured. Prior to initiating any bump test, the papermaking machine is first operated at predetermined baseline conditions. By "baseline conditions" is meant those operating conditions whereby the machine produces paper. Typically, the baseline conditions will correspond to standard or optimized parameters for papermaking. Given the expense involved in operating the machine, extreme conditions that may produce defective, non-useable paper is to be avoided. In a similar vein, when an operating parameter in the system is modified for the bump test, the change should not be so drastic as to damage the machine or produce defective paper. After the machine has reached steady state or stable operations, the water weights at each of the three sensors are measured and recorded. Sufficient number of measurements over a length of time are taken to provide representative data. This set of steady-state data will be compared with data following each test. Next, a bump test is conducted. The following data were generated on a Beloit Concept 3 papermaking machine, manufactured by Beloit Corporation, Beloit, Wis. The calculations were implemented using a microprocessor using LABVIEW 4.0.1 software from National Instrument (Austin Tex.).

Figure 4:
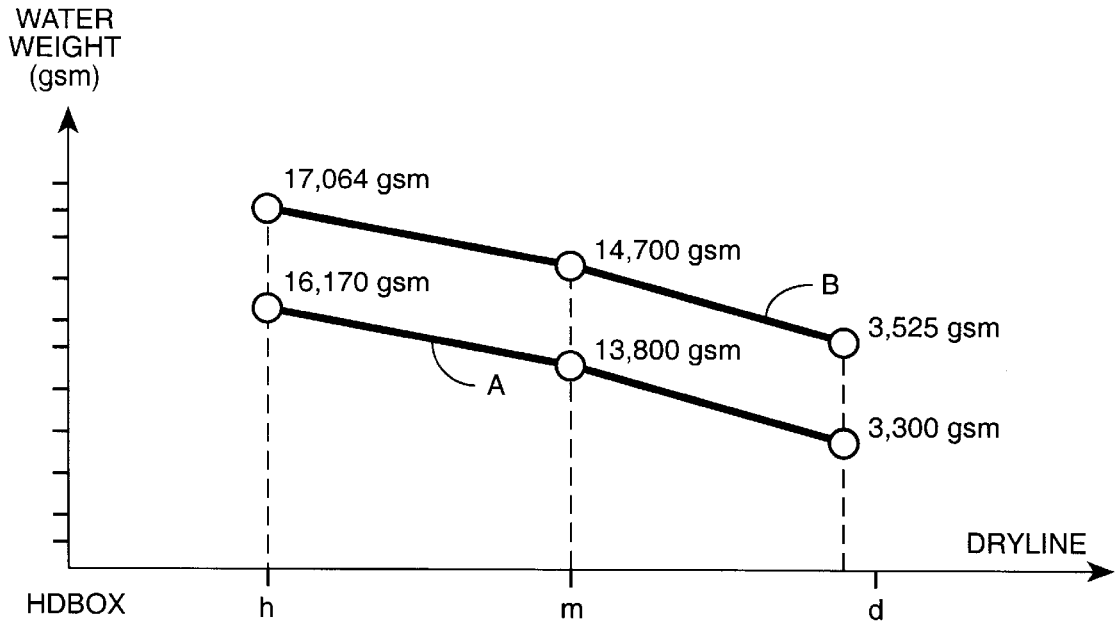
FIG. 4 shows a graph of water weight vs. wire position of a papermaking machine with different consistency in the stock.

(1) Dry stock flow test. The flowrate of dry stock delivered to the headbox is changed from the baseline level to alter the paper stock composition. Once steady state conditions are reached, the water weights are measured by the three sensors and recorded. Sufficient number of measurements over a length of time are taken to provide representative data. FIG. 4 is a graph of water weight vs. wire position measured during baseline operations and during a dry stock flow bump test wherein the dry stock was increased by 100 gal/min from a baseline flow rate of 1629 gal/min. Curve A connects the three water weight measurements during baseline operations and curve B connects the measurements during the bump test. As is apparent, increasing the dry stock flow rate causes the water weight to increase. The reason is that because the paper stock contains a high percentage of pulp, more water is retained by the paper stock. The percentage difference in the water weight at positions h, m, and d along the wire are +5.533%, +6.522%, and +6.818%, respectively.

For the dry stock flow test, the controls on the papermaking machine for the basic weight and moisture are switched off and all other operating parameters are held as steady as possible. Next, the stock flow rate is increased by 100 gal/min. for a sufficient amount of time, e.g., about 10 minutes. During this interval, measurements from the three sensors are recorded and the data derived therefrom are shown in FIG. 4.

Figure 5:
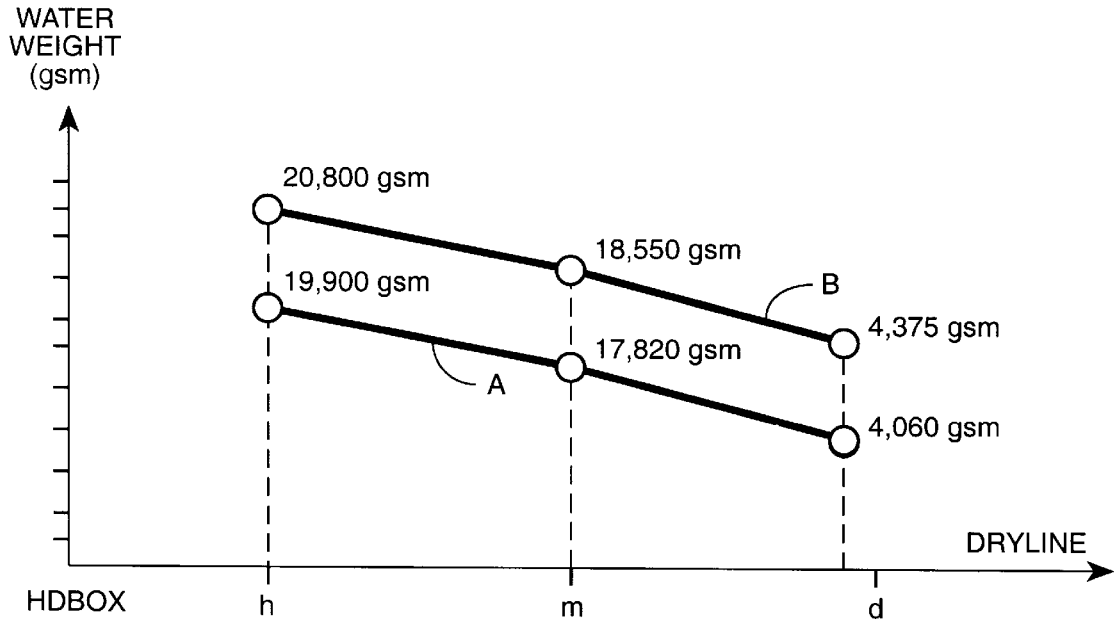
FIG. 5 shows a graph of water weight vs. wire position of a papermaking machine with a different refiner power.

(2) Freeness test. As described previously, one method of changing the freeness of paper stock is to alter the power to the refiner which ultimately effects the level of grinding the pulp is subjected to. During the freeness test, once steady state conditions are reached, the water weights at each of the three sensors are measured and recorded. In one test, power to the refiner was increased from about 600 kw to about 650 kw. FIG. 5 is a graph of water weight vs. wire position measured during baseline operations (600 kw) (curve A) and during the steady state operations after an additional 50 kw are added (curve B). As expected, the freeness was reduced resulting in an increase in the water weight (FIG. 5, curve B) as in the dry stock flow test. Comparison of the data showed that the percentage difference in the water weight at positions h, m, and d are +4.523%, +4.658%, and +6.281%, respectively.

(3) Total paper stock flow rate (slice) test. One method of regulating the total paper stock flow rate from the head box is to adjust aperture of the slice. During this test, once steady state conditions are reached, the water weights at each of the three sensors are measured and recorded. In one test, the slice aperture was raised from about 1.60 in. (4.06 cm) to about 1.66 in. (4.2 cm) thereby increasing the flow rate. As expected, the higher flow rate increased the water weight. Comparison of the data showed that the percentage difference in the water weight at positions h, m, and d are +9.395%, +5.5%, and +3.333%, respectively. (The measurement at position m of 5.5% is an estimate since the sensor at this location was not in service when the test was performed.)

The Drainage Characteristic Curves (DCC)

From the previously described bump tests one can derive a set of drainage characteristic curves (DCC). The effect of changes in three process parameters on the three water weight sensor values provides nine partial derivatives which form a 3×3 DCC matrix. Generally, when employing n number of water weight sensors mounted on the wire and m bump tests, a n×m matrix is obtained.

Specifically, the 3×3 DCC matrix is given by:

$$\begin{bmatrix} DC_{Th} & DC_{Tm} & DC_{Td} \\ DC_{Fh} & DC_{Fm} & DC_{Fd} \\ DC_{Sh} & DC_{Sm} & DC_{Sd} \end{bmatrix}$$

where T, F, S refer to results from bumps in the total water flow, freeness, and dry stock flow, respectively, and h, m, and d designate the positions of the sensors mounted along the fabric.

The matrix row components $[DC_{Th}DC_{Tm}DC_{Td}]$ are defined as the percentage of water weight change on total water weight at locations h, m, and d based on the total flow rate bump tests. More precisely, for example, "$DC_{Th}$" is defined as the difference in percentage water weight change at position h at a moment in time just before and just after the total flow rate bump test. $DC_{Tm}$ and $DC_{Td}$ designate the values for the sensors located at positions m and d, respectively. Similarly, the matrix row components $[DC_{Fh}DC_{Fm}DC_{Fd}]$ and $[DC_{Sh}DC_{Sm}DC_{Sd}]$ are derived from the freeness and dry stock bump tests, respectively.

Components $DC_{Th}$, $DC_{Fm}$ and $DC_{Sd}$ on the DDC matrix are referred to pivotal coefficients and by Gauss elimination, for example, they are used to identify the wet end process change as further described herein. If a pivot coefficient is too small, the uncertainty in the coefficients will be amplified during the Gauss elimination process. Therefore, preferably these three pivotal coefficients should be in the range of about 0.03 to 0.10 which corresponds to about 3% to 10% change in the water weight during each bump test.

Drainage Profile Change

Based on the DCC matrix, the drainage profile change can be represented as a linear combination of changes in the different process parameters. Specifically, using the DCC matrix, the percentage change in the drainage profile at each location may be computed as a linear combination of the individual changes in the process parameters: total water flow, freeness, and dry stock flow. Thus:

$$\Delta DP\%(h,t)=DCTh*w+DCFh*f+DCSh*s,$$

$$\Delta DP\%(m,t)=DCTm*w+DCFm*f+DCSm*s,$$

$$\Delta DP\%(d,t)=DCTd*w+DCFd*f+DCSd*s,$$

where (w, f, s) refer to changes in total water flow, freeness, and dry stock flow respectively, and the DC's are components of the DCC matrix.

By inverting this system of linear equations, one may solve for the values of (w, j, s) needed to produce a specified drainage profile change (ΔDP%(h), ΔDP%(m), ΔDP%(d). Letting A represent the inverse of the DCC matrix, $$\begin{bmatrix} A_{11} & A_{12} & A_{13} \\ A_{21} & A_{22} & A_{23} \\ A_{31} & A_{32} & A_{33} \end{bmatrix} \begin{matrix} \Delta DP\,\%\,(h) \\ \Delta DP\,\%\,(m) \\ \Delta DP\,\%\,(d) \end{matrix} = \begin{bmatrix} w \\ f \\ s \end{bmatrix} \quad \text{or}$$

$$w = A_{11} * \Delta DP\,\%\,(h) + A_{12} * \Delta DP\,\%\,(m) + A_{13} * \Delta DP\,\%\,(d)$$

$$f = A_{21} * \Delta DP\,\%\,(h) + A_{22} * \Delta DP\,\%\,(m) + A_{23} * \Delta DP\,\%\,(d)$$

$$s = A_{31} * \Delta DP\,\%\,(h) + A_{32} * \Delta DP\,\%\,(m) + A_{33} * \Delta DP\,\%\,(d)$$

The above equation shows explicitly how inverting the DCC matrix allows one to compute the (w, f, s) needed to effect a desired change in drainage profile, (ΔDP%(h), ΔDP%(m), ΔDP%(d)).

Empirically, the choice of the three operating parameters, the location of the sensors, and the size of the bumps produces a matrix with well behaved pivot coefficients, and the matrix can thus be inverted without undue noise.

By continuously comparing the dry weight measurement from scanner 19 in FIGS. 1 and 2 with the water weight profiles measured at sensors h, m, and d, one can make a dynamic estimate of the final dry stock weight will be for the paper stock that is at the position of scanner 19.

Dry Stock Prediction

At location d which is closest to the drying section, the state of the paper stock is such that essentially all of the water is held by the fiber. In this state, the amount of water bonded to or associated with the fiber is proportional to the fiber weight. Thus the sensor at location d is sensitive to changes in the dry stock and is particularly useful for predicting the weight of the final paper stock. Based on this proportionality relation: DW(d)=U(d)*C(d), where DW(d) is the predicted dry stock weight at location d, U(d) is the measured water weight at location d and C(d) is a variable of proportionality relating DW to U and may be referred to as the consistency. Further, C(d) is calculated from historical data of the water weight and dry weight measured by the scanning sensor at reel-up.

Subsequent to position d in the papermaking machine (see FIGS. 1 and 2), the sheet of stock exits wire 12 and travels into calendaring stack 14 and dryer 15. At location 19, a scanning sensor measures the final dry stock weight of the paper product. Since there is essentially no fiber loss subsequent to location d, it may be assumed that DW(d) is equal to the final dry stock weight and thus one can calculate the consistency C(d) dynamically.

Having obtained these relations, one can then predict the effect of changes in the process parameters on the final dry stock weight. As derived previously the DCC matrix predicts the effect of process changes on the drainage profile. Specifically in terms of changes in total water flow w, freeness, and dry stock flow s, the change in U(d) is given by:

$$\Delta U(d)/U(d)=DC_{Td}$$

where Ref(cd) is a dynamic calculated value based on current dry weight sensor and historical water weight sensory readings where the α's are defined to be gain coefficients which were obtained during the three bump tests previously described. Finally, the perturbed dry stock weight at location d is then given by:

$$Dw(d)=U(d)*\{1+[\alpha_T DC_{Td}*w+\alpha_F DC_{Fd}\cdot f+d_s DC_{Sd}*s]\}*Ref(c)$$

The last equation thus describes the effect on dry stock weight due to a specified change in process parameters. Conversely, using the inverse of the DCC matrix one can also deduce how to change the process parameters to produce a desired change in dry weight (s), freeness (f) and total water flow (w) for product optimizations.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of controlling the formation of a sheet of wet stock comprising fibers wherein a sheet of the wet stock is formed and moves at a sheet speed on a water permeable wire moving at a wire speed of a de-watering machine that has a headbox having at least one slice, wherein each slice has an aperture through which wet stock is introduced onto the wire at a stock jet speed, said method comprising the steps of:

a) placing at least two water weight sensors underneath and adjacent to the wire and which are positioned at different locations in the direction of movement of the wire and upstream from a dry line which develops during operation of the machine;

b) operating the machine and measuring the water weights of the moving sheet of wet stock with the water weight sensors;

c) generating signals that are indicative of the water weight measurements and developing a water weight profile based on the signals; and d) adjusting at least one of said stock jet speed, sheet speed, or wire speed so that the water weight profile matches a preselected water weight profile by measuring the wire speed and either (i) the stock jet speed or (ii) the sheet speed and maintaining either (i) the stock jet speed to wire speed ratio or (ii) the sheet speed to wire speed ratio between about 0.95 to 1.05 provided that the ratio is not maintained at exactly 1.

2. The method of claim 1 wherein step a) comprises placing at least three water weight sensors and said method further comprising the step of predicting the dry stock weight of a sheet of wet stock on the wire.

3. The method of claim 2 further comprising the step of determining the change in the predicted dry stock weight of a sheet of wet stock on the wire in response to changes in one of said stock jet speed, sheet speed, or wire speed.

4. The method of claim 1 wherein the headbox has actuators that control the discharge of wet stock through a plurality of slices and step d) comprises controlling the discharge of wet stock through the slices.

5. The method of claim 1 wherein the headbox comprises a chamber containing wet stock that is maintained at a pressure level, and step d) comprises adjusting the pressure within the chamber.

6. The method of claim 1 wherein each of said sensors includes a first electrode and a second electrode which is spaced-apart and adjacent to said first electrode, said wet stock being between and in close proximity to said first and said second electrodes, said sensor is coupled in series with an impedance element between an input signal and a reference potential; and wherein fluctuations in at least one of said properties of said wet stock causes changes in voltage measured across said sensor.

7. The method of claim 6 wherein said first electrode is coupled to said impedance element and said second electrode is coupled to said reference potential.

8. The method of claim 7 wherein said impedance element comprises a plurality of resistive elements and said first electrode comprises a plurality of electrically isolated sub-electrodes which are each coupled to one of said plurality of resistive elements.

9. The method of claims 7 further including a third electrode coupled to said reference potential, said first electrode being spaced-apart and residing between said second and said third electrodes, wherein another portion of said sheet of material is between and in close proximity to said first and said third electrodes.

10. The method of claim 6 wherein said first electrode is coupled to said input signal and said second electrode is coupled to said impedance element.

11. The method of claim 10 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

12. The method of claim 6 further comprising means for providing a feedback signal to adjust said input signal such that said fluctuations in at least one of said properties are due to fluctuations in a single physical characteristic of said wet stock.

13. The method of claim 12 wherein said physical properties include dielectric constant, conductivity, and proximity of said portion of said wet stock to said sensor and said single physical characteristic of said wet stock comprises one of weight, chemical composition, and temperature.

14. The method of claim 6 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

15. The method of claim 14 wherein said sensor has an associated impedance and said associated frequency is adjusted such that said sensor impedance and said impedance of said one of said capacitive element and said inductive element are approximately equal.

16. The method of claim 1 wherein the at least two water weight sensors are positioned substantially in tandem.

17. The method of claim 16 wherein step a) comprises placing at least three sensors underneath and adjacent to the wire.

18. The method of claim 1 wherein the wet stock is paper stock.

19. A system of controlling the formation of wet stock which comprises fibers on a moving water permeable wire of a de-watering machine that comprises a headbox having at least one slice, wherein each slice has an aperture through which wet stock is discharged at a stock jet speed onto the wire that is moving at a wire speed wherein a sheet of the wet stock develops on the wire and moves at a sheet speed, which system comprises:

a) at least two water weight sensors that are positioned adjacent to the wire wherein the sensors are positioned at different locations in the direction of movement of the wire and downstream from a dry line which develops during operation of the machine and the sensors generate signals indicative of a water weight profile made up of a multiplicity of water weight measurements;

b) means for adjusting at least one of the stock jet speed, sheet speed, or wire speed, to cause the water weight profile to match a preselected water weight profile;

(c) means for adjusting at least one of the stock jet speed, sheet speed or wire speed; and (d) means for maintaining either the stock jet speed to wire speed ratio or the sheet speed to wire ratio between about 0.95 to 1.05 provided that the ratio is not maintained at exactly 1.

20. The system of claim 19 wherein at least three water weight sensors are positioned and said system further comprising means for predicting the dry stock weight of a sheet of wet stock on the wire.

21. The system of claim 20 further comprising means for determining the change in the predicted dry stock weight of a sheet of wet stock on the wire in response to changes in one of said stock jet speed, sheet speed, or wire speed.

22. The system of claim 19 wherein the headbox has actuators that control the discharge of wet stock through a plurality of slices and wherein the means for regulating jet speed regulates the discharge of wet stock through the slices.

23. The system of claim 19 wherein the headbox comprises a chamber containing wet stock that is maintained at a pressure level and the means for regulating the jet speed regulates said pressure.

24. The system of claim 19 wherein each of said sensors includes a first electrode and a second electrode which is spaced-apart and adjacent to said first electrode, said wet stock being between and in close proximity to said first and said second electrodes, said sensor is coupled in series with said impedance element between an input signal and a reference potential; and wherein fluctuations in at least one of said properties of said wet stock causes changes in voltage measured across said sensor.

25. The system of claim 24 wherein said first electrode is coupled to said impedance element and said second electrode is coupled to said reference potential.

26. The system of claim 25 wherein said impedance element comprises a plurality of resistive elements and said first electrode comprises a plurality of electrically isolated sub-electrodes which are each coupled to one of said plurality of resistive elements.

27. The system of claim 26 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

28. The system of claims 25 further including a third electrode coupled to said reference potential, said first electrode being spaced-apart and residing between said second and said third electrodes, wherein another portion of said sheet of material is between and in close proximity to said first and said third electrodes.

29. The system of claim 24 wherein said first electrode is coupled to said input signal and said second electrode is coupled to said impedance element.

30. The system of claim 24 further comprising means for providing a feedback signal to adjust said input signal such that said fluctuations in at least one of said properties are due to fluctuations in a single physical characteristic of said wet stock.

31. The system of claim 30 wherein said physical properties include dielectric constant, conductivity, and proximity of said portion of said wet stock to said sensor and said single physical characteristic of said wet stock comprises one of weight, chemical composition, and temperature.

32. The system of claim 24 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

33. The system of claim 32 wherein said sensor has an associated impedance and said associated frequency is adjusted such that said sensor impedance and said impedance of said one of said capacitive element and said inductive element are approximately equal.

34. The system of claim 19 wherein the water weight sensors are positioned substantially in tandem.

35. The system of claim 34 wherein the system comprises at least three sensors that are underneath and adjacent to the wire.

36. The system of claim 19 wherein the wet stock is paper stock.

* * * * *